US010151551B2

(12) United States Patent
Cheng

(10) Patent No.: US 10,151,551 B2
(45) Date of Patent: Dec. 11, 2018

(54) GUN DEVICE ALLOWING REPLACEMENT OF BARRELS WITH DIFFERENT SIZES

(71) Applicant: KRISS INDUSTRIES ASIA LTD., Taipei (TW)

(72) Inventor: Li-Te Cheng, Taipei (TW)

(73) Assignee: KRISS INDUSTRIES ASIA LTD., Taipei (TW)

( * ) Notice: Subject to any disclaimer, the term of this patent is extended or adjusted under 35 U.S.C. 154(b) by 0 days.

(21) Appl. No.: 15/140,643

(22) Filed: Apr. 28, 2016

(65) Prior Publication Data

US 2017/0184368 A1 Jun. 29, 2017

(30) Foreign Application Priority Data

Dec. 29, 2015 (TW) ..... 104221049 U

(51) Int. Cl.
*F41A 21/48* (2006.01)

(52) U.S. Cl.
CPC ..... *F41A 21/484* (2013.01); *F41A 21/485* (2013.01)

(58) Field of Classification Search
CPC ..... F41A 21/484–21/485
USPC ..... 42/75.02
See application file for complete search history.

(56) References Cited

U.S. PATENT DOCUMENTS 4,920,679 A * 5/1990 Sarles ..... F41A 21/481 42/75.02
8,141,287 B2 * 3/2012 Dubois ..... F41A 11/02 42/75.01
8,782,943 B2 * 7/2014 Jarboe ..... F41A 21/485 42/75.02

* cited by examiner

*Primary Examiner* — Stephen Johnson
*Assistant Examiner* — Benjamin S Gomberg
(74) *Attorney, Agent, or Firm* — Locke Lord LLP; Tim Tingkang Xia, Esq.

(57) ABSTRACT

A gun device allowing replacement of barrels with different sizes, having a gun body, one end of the gun body has an opening. The opening outer edge has a threading and a positioning slot. The gun body connects with a first size barrel by connecting the threading with a lock. The gun device further comprising: a guide adapter, a second size barrel and a barrel key. The guide adapter has a positioning body, a projecting part, and a first groove, the projecting part alignment connects with the positioning slot. The second size barrel has a second groove, the first groove corresponding with the second groove.

6 Claims, 2 Drawing Sheets

GUN DEVICE ALLOWING REPLACEMENT OF BARRELS WITH DIFFERENT SIZES

CROSS REFERENCE

This non-provisional application claims priority from Taiwan Patent Application NO. 104221049, filed on Dec. 29, 2015, the content thereof is incorporated by reference herein.

FIELD OF THE INVENTION

The present invention relates to a gun device allowing replacement of barrels with different sizes and, more particularly, to a gun body allowing replacement of a barrel of an AR-15 automatic rifle with a barrel of a Ruger 10/22 automatic rifle.

BACKGROUND OF THE INVENTION

An automatic rifle is capable of self-loading, burst fire mode, and fully automatic firing. It uses its recoil or a portion of the gas propelling a projectile to remove old spent cartridge cases, load a new cartridge and fire again. Hence, once its trigger is pulled, the automatic rifle will start burst firing, and the burst firing will not stop until the rifle runs out of bullets.

Automatic rifle manufacturers care about the optimization and quality of their automatic rifles. The dimensions of all the parts and components of conventional automatic rifles must be precisely calculated and corrected for the sake of practicability, durability, and precision. The type of bullets for use in automatic rifles depends on the model numbers of the automatic rifles. As a result, there is limited universality of parts and components between conventional automatic rifles.

Firearms in use among civilians nowadays in Europe and North America are mostly AR-15 automatic rifles, 0.22 inch caliber automatic rifles, handguns, etc. AR-15 automatic rifles use bullets which are 5.56 mm in caliber and 45 mm in length, whereas 0.22 inch caliber automatic rifles use bullets which are 0.22 inch in caliber. The great difference in applicable bullets between an AR-15 automatic rifle and a 0.22 inch caliber automatic rifle renders it impossible for an AR-15 automatic rifle and a 0.22 inch caliber automatic rifle to use the same bullet. As a result, AR-15 automatic rifles differ from 0.22 inch caliber automatic rifles in a cartridge, an action, a barrel and even a gun body. Therefore, rifle users must choose bullets in accordance with the equipment in use.

The bullets for use with AR-15 automatic rifles surpass the bullets for use with Ruger 10/22 automatic rifles in caliber, length, quantity of gunpowder contained, and firing range. Hence, AR-15 automatic rifles are suitable for use in medium- and long-distance field combats. By contrast, although the bullets for use with Ruger 10/22 automatic rifles are disadvantageously dwarfed by their counterparts in caliber, length, quantity of gunpowder contained, and firing range, the bullets for use with Ruger 10/22 automatic rifles have their advantages, namely low recoil, low noise, and low manufacturing costs. Therefore, the bullets for use with Ruger 10/22 automatic rifles are commonly used with private hunting in Europe and North America. However, according to a limit of the firearm, more than two bullets cannot be adapted in the same rifle. It is important to overcome the aforesaid drawbacks of the prior art.

SUMMARY OF THE INVENTION

In view of the aforesaid drawbacks of conventional automatic rifles, the inventor of the present invention is motivated to improve conventional automatic rifles and thereby provides a gun body structure which can use bullets of different specifications and is applicable to AR15 automatic rifles, thereby allowing AR15 automatic rifles to use 0.22 inch caliber bullets.

In order to achieve the above and other objectives, the present invention provides a gun device allowing replacement of barrels with different sizes, comprising a gun body, one end of the gun body having an opening, the opening outer edge having a threading and a positioning slot, the gun body composing a first size barrel via connecting the threading with a lock, the gun device further comprising: a guide adapter, having a positioning body, a projecting part, and a first groove, the projecting part alignment connecting with the positioning slot when the guide adapter is disposed in the opening; a second size barrel, having a second groove, the first groove corresponding with the second groove when one end of the second size barrel is disposed in the guide adapter; a barrel key for disposing between the first groove and the second groove, both side of the barrel key is nestled and fixed with both side of the first groove; wherein the first size barrel is separated from the gun body, disposing the guide adapter, the second size barrel and the barrel key in the opening, and connecting the lock and the threading to compose integrally the gun body with the second size barrel.

In an embodiment of the present invention, the guide adapter has a through-hole for fixing the guide adapter and the second size barrel via disposing a set screw in the through-hole.

In an embodiment of the present invention, the gun body is an AR15 (Armalite Rifle-15) automatic rifle.

In an embodiment of the present invention, the first size barrel is an AR15 automatic rifle's barrel. An inner diameter of the first size barrel is 5.56 mm caliber.

In an embodiment of the present invention, the second size barrel is a Ruger 10/22 automatic rifle's barrel. An inner diameter of the second size barrel is 0.22 inch caliber.

In an embodiment of the present invention, the positioning body is an annular structure formed on the guide adapter outer edge and contacting the lock.

BRIEF DESCRIPTION OF THE DRAWINGS

Objectives, features, and advantages of the present invention are illustrated with specific embodiments in conjunction with the accompanying drawings, in which.

DETAILED DESCRIPTION OF THE EMBODIMENTS

Figure 1:
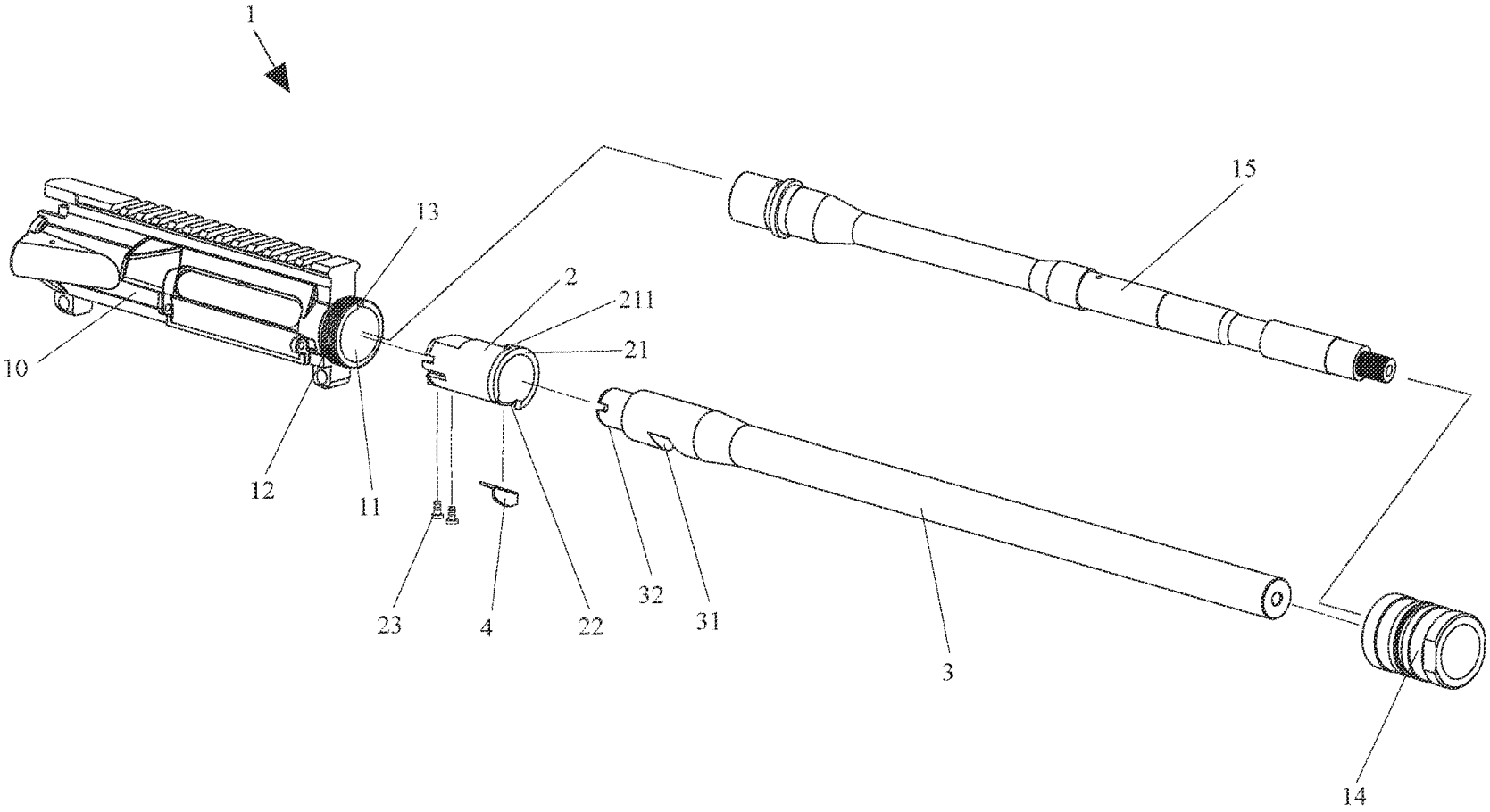
FIG. 1 is an exploded view of a gun device allowing replacement of barrels with different sizes according to a preferred embodiment of the present invention.
Figure 2:
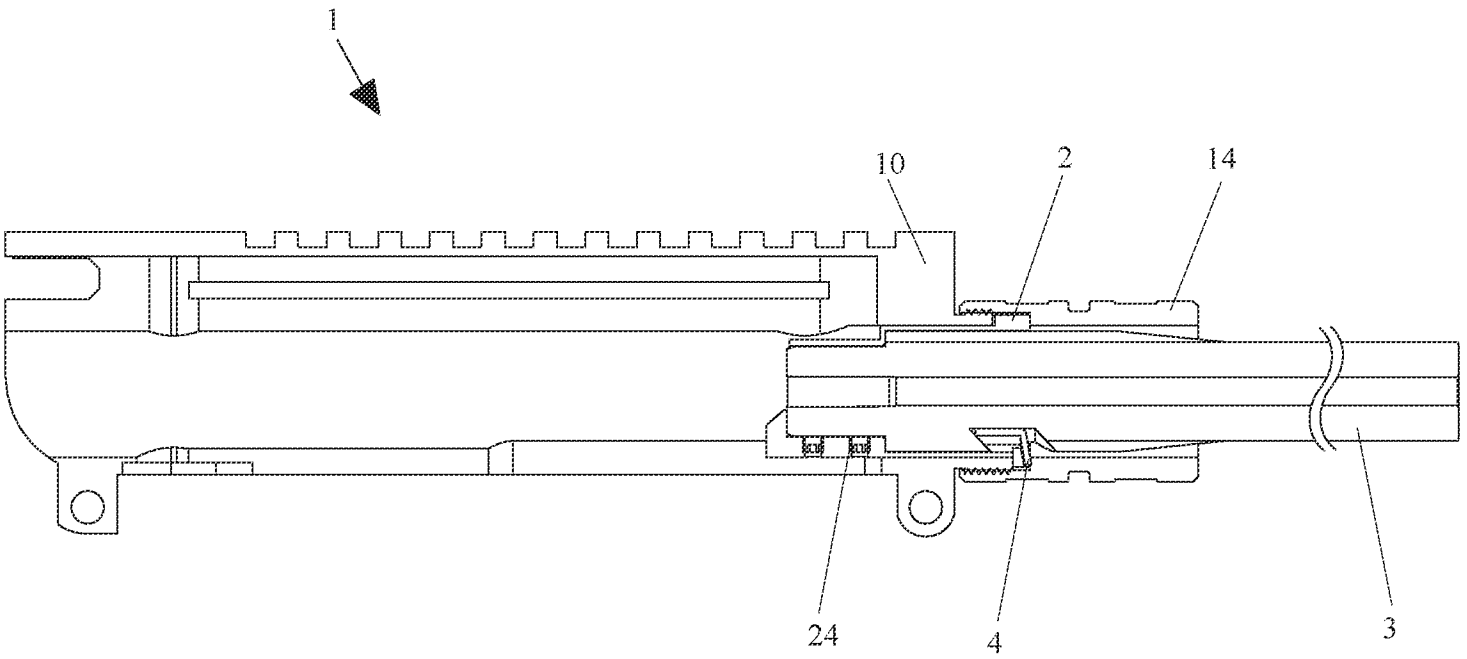
FIG. 2 is a cross-sectional view of a gun device allowing replacement of barrels with different sizes according to the preferred embodiment of the present invention.

Referring to FIG. 1 and FIG. 2, there are shown an exploded view and a cross-sectional view of a gun device allowing replacement of barrels with different sizes according to a preferred embodiment of the present invention. The gun device 1 has a gun body 10. The gun body 10 is adapted for use with an AR-15 (Armalite Rifle-15, AR15) automatic rifle. One end of the gun body 10 has an opening 11. The opening 11 outer edge has a threading 12 and a positioning slot 13. The threading 12 is used for connecting with a first size barrel 15. The gun body 10 composes the first size barrel 15 via connecting the threading 12 with a lock 14. The first size barrel 15 is an AR15 automatic rifle's barrel. The inner diameter of the first size barrel 15 is 5.56 mm caliber.

The gun device 1 allowing replacement of barrels with different sizes further comprises: a guide adapter 2, a second size barrel 3 and a barrel key 4.

The guide adapter 2 is a hollow cylindrical structure. An outer diameter of one end of the guide adapter 2 is smaller than an inner diameter of the opening 11 such that the one end of the guide adapter 2 can be partially disposed in the opening 11. The guide adapter 2 has a positioning body 21, a projecting part 211, and a first groove 22. The positioning body 21 is an annular structure formed on the guide adapter 2 outer edge and contacting the lock 14. The projecting part 211 extends from the positioning body 21 and the first groove 22 is formed on the positioning body 21. The projecting part 211 alignment connects with the positioning slot 13 when the guide adapter 2 is disposed in the opening 11. In the preferred embodiment of the present invention, the first groove 22 is formed at the other side of the projecting part 211.

The second size barrel 3 is a Ruger 10/22 automatic rifle's barrel. An inner diameter of the second size barrel 3 is 0.22 inch caliber that can use 0.22 inch caliber bullets. An outer diameter of one end 32 of the second size barrel 3 is smaller than the inner diameter of the other end of the guide adapter 2 such that the one end 32 of the second size barrel 3 can be partially disposed in the other end of the guide adapter 2. The second size barrel 3 has a second groove 31. The first groove 22 corresponding with the second groove 31 when the one end 32 of the second size barrel 3 is disposed in the guide adapter 2. Preferably, the guide adapter 2 has at least one through-hole 24 for fixing the guide adapter 2 and the second size barrel 3 via disposing a set screw 23 in the through-hole 24.

The barrel key 4 is disposed between the first groove 22 and the second groove 31. Both sides of the barrel key 4 are nestled and fixed with both sides of the first groove 22.

To replace the first size barrel 15, the first size barrel 15 is separated from the gun body 10. The guide adapter 2, the second size barrel 3 and the barrel key 4 are disposed in the opening 11. The barrel key 4 is nestled and fixed the first groove 22 to fix the guide adapter 2, the second size barrel 3 and the gun body 10, and the lock 14 is connected to the threading 12 to form the gun body 10 connected with the second size barrel 3.

Referring to all the above diagrams, the present invention discloses a gun device 1 allowing replacement of barrels with different sizes. The gun device 1 allowing replacement of barrels with different sizes is applicable to the gun body 10 of AR-15 automatic rifles such that the AR-15 automatic rifles can use 0.22 inch caliber bullets after replacing the first size barrel 15 with the second size barrel 3 on the gun body 10.

The above description shows sufficiently that the present invention is novel, involves inventive steps, and has high industrial applicability in terms of its objectives and advantages, thereby meeting the requirements of patentability. However, the above description is focused on a preferred embodiment of the present invention only and therefore is not restrictive of the present invention. All equivalent changes and modifications made to the preferred embodiment of the present invention according to the claims of the present invention should fall within the claims of the present invention.

What is claimed is:

1. A gun allowing replacement of barrels with different caliber sizes, having a gun body, one end of the gun body having an opening, an outer edge of the opening having a threading and a positioning slot, the gun body assembled to a first barrel having a first caliber via connecting the threading with a lock, said gun further comprising:

a guide adapter having a positioning body, a projecting part, and a first groove, the projecting part being aligned to and connected with the positioning slot when the guide adapter is disposed in the opening;

a second barrel having a second caliber and a second groove, the first groove corresponding with the second groove when one end of the second barrel is disposed in the guide adapter; and a barrel key having two sides and being disposed between the first groove and the second groove, the first groove having two sides, the two sides of the barrel key being fixed with the two sides of the first groove, wherein the barrel key comprises a first flat portion and a second flat portion folded from the first flat portion such that the first flat portion and the second flat portion form an obtuse angle;

wherein the gun body is assembled to the second barrel by separating the first barrel from the gun body, disposing the guide adapter, the second barrel and the barrel key in the opening, and connecting the lock to the threading.

2. The gun allowing replacement of barrels with different caliber sizes of claim 1, wherein the guide adapter comprises a through-hole for fixing the guide adapter and the second barrel to one another via disposing a set screw in the through-hole.

3. The gun allowing replacement of barrels with different caliber sizes of claim 1, wherein the gun body is an AR-15 type automatic rifle gun body.

4. The gun allowing replacement of barrels with different caliber sizes of claim 1, wherein the first barrel is an AR-15 type automatic rifle barrel with an inner diameter of substantially 5.56 mm.

5. The gun allowing replacement of barrels with different caliber sizes of claim 1, wherein the second barrel has an inner diameter of substantially 0.22 inches.

6. The gun allowing replacement of barrels with different caliber sizes of claim 1, wherein the positioning body is annular and formed on an outer edge of the guide adapter and contacting the lock.

* * * * *